United States Patent [19]

Loevendie

[11] 4,374,504

[45] Feb. 22, 1983

[54] SUCTION DREDGER BARGE

[75] Inventor: Rudolf H. Loevendie, Alblasserdam, Netherlands

[73] Assignee: IHC Holland N.V., Papendrecht, Netherlands

[21] Appl. No.: 254,204

[22] Filed: Apr. 14, 1981

[30] Foreign Application Priority Data

Apr. 14, 1980 [NL] Netherlands ..... 8002154

[51] Int. Cl.[3] ..... B63B 3/38; B63B 41/00

[52] U.S. Cl. ..... 114/37; 114/125; 114/27; 114/73; 37/56

[58] Field of Search ..... 114/125, 121, 122, 73, 114/74 R, 74 A, 74 T, 26, 27, 36, 37, 333; 37/56

[56] References Cited

U.S. PATENT DOCUMENTS

| | | | |
|---|---|---|---|
| 708,541 | 9/1902 | Frühling | 114/26 |
| 1,706,035 | 3/1929 | Nacey | 114/26 |
| 2,594,930 | 4/1952 | Hudson . | |
| 2,845,890 | 8/1958 | Damoon . | |
| 3,578,222 | 5/1971 | Pot | 114/36 |
| 4,014,358 | 3/1977 | Andersson | 114/74 R |

FOREIGN PATENT DOCUMENTS

| | | | |
|---|---|---|---|
| 159866 | 8/1903 | Fed. Rep. of Germany . | |
| 723 | 6/1915 | Netherlands . | |
| 6815628 | 11/1968 | Netherlands | 114/26 |
| 6815628 | 5/1970 | Netherlands . | |
| 7008152 | 8/1970 | Netherlands . | |
| 7217195 | 6/1974 | Netherlands . | |

*Primary Examiner*—Trygve M. Blix
*Assistant Examiner*—D. W. Keen
*Attorney, Agent, or Firm*—Young & Thompson

[57] ABSTRACT

The invention relates to a suction dredge barge in which the air chambers (8,9) on either side of the hold (2) can be filled with mud via an overflow (14) at the top edge of the hold (2) said air chambers (8,9) having inclined bottoms (10,11) and discharge openings (12,13) towards the hold at the lower edge of said inclined bottoms (10,11).

2 Claims, 1 Drawing Figure

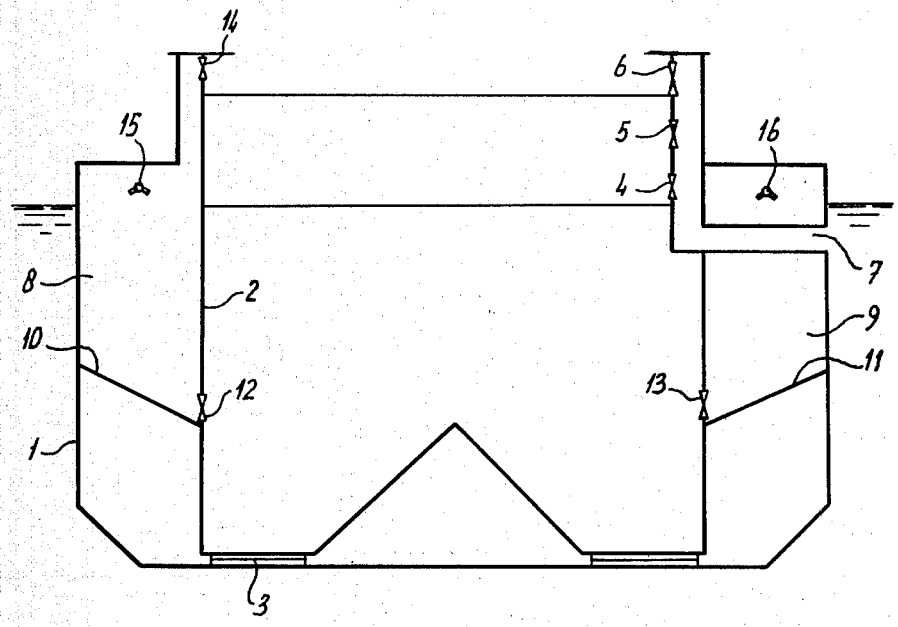
14
6
15
5
16
4
7
8
2
9
10
11
12
13
1
3

SUCTION DREDGER BARGE

The invention relates to an suction dredger barge having a hold, said hold being provided with a overflow debouching outside the hull of the dredger barge and said hull being provided with air chambers on either side of said hold. Such suction dredger barges are known in general. One distinguishes thereby between suction dredger barges for heavy loads, namely sand or gravel having a specific mass of more than 1.6 and suction dredger barges for light loads such as mud. The charging of dredger barges destined for heavy loads is carried out by pumping a mixture of sand and water into the hold in which hold a separation between the sand and water will occur, the water being discharged to the outside when the level thereof will reach the overflow. This way of charging is continued until too much sand is entrained by overflowing water. Some of the known dredger barges have a plurality of overflows arranged above each other which overflows may be closed successively during charging.

Such a heavy load dredger barge will be rather frequently utilized for dredging mud. The hold may accordingly be filled completely but the carrying-capacity of the vessel will not be utilized completely because of the lower specific mass.

The object of the invention is to provide a suction dredger barge positively allowing for such use.

According to the invention this object is attained in that the hold is provided in addition to the aforesaid overflow with a disconnectable overflow debouching into said air chambers. Consequently the dredger barge will be able to take a larger mass of mud and may hence be utilized more efficiently in such case.

It is surprising that the stability is not affected detrimentally by charging the air chambers with mud.

The structural parts present in the air chambers and necessary for the strength of the vessel do not inhibit the removal of the mud from the air chambers because the mud is of liquid character.

Preferably the air chambers are in disconnectable communication with the hold at the lower edge of an inwardly inclined bottom. This communication may be provided by butterfly valves, slide valves or non-return valves allowing a flow in the direction of the hold. Upon discharge the charge will then flow out of the air chambers by way of the hold.

If necessary the air chambers may be provided with flushing means which are installed preferably in the top part.

The invention will be elucidated in further detail with reference to the accompanying drawing diagrammatically representing the hull of a suction dredger barge in cross section.

The suction dredger barge represented in the drawing possesses a hull 1 including a hold 2 and bottom valves or slide valves 3.

As indicated in the right hand side of the drawing the inner wall of the hold has been provided with a plurality of overflows 4, 5 and 6 which may be closed and through which water by way of the channel 7 may flow to the outside.

At the left hand side as well as at the right hand side of the hold there are air chambers 8 and 9 which in accordance with the invention have been built as mud tanks. These tanks possess an inwardly inclined bottom 10 and 11, respectively, and are provided with valves 12 and 13, respectively, in the bottom part thereof.

At the level of the upper edges of the walls of the hold 2 there is provided an overflow 14 which may be closed and which in the opened condition thereof allows a mud flow to the mud tanks 8 and 9, respectively, when the maximum level in the hold 2 is reached.

Although solely in the left hand part of the drawing a mud overflow 14 has been drawn it will nevertheless be clear that such overflow will also be present at the right hand side next to the overflow 6 and that at the left hand side there will be provided also overflows 4, 5 and 6 for water debouching in a similar way outside the vessel.

In the top part both the mud tanks 8 and 9 have been provided with flushing means 15 and 16, respectively, so that upon discharge with the bottom valves or slide valves 3 in opened position the contents of the mud tanks may flow or may be flushed into the hold by way of the opened valves 12 and 13, or self-opening no-return valves 12 and 13, respectively.

I claim:

1. A suction dredger having a central hold and air chambers located on both sides of the hold, said central hold having an overflow toward the outside of the hull and an overflow toward said air chambers, control valves for opening and closing the latter overflow, said air chambers having bottom walls that incline downwardly toward the central hold, discharge valves between the air chambers and the central hold at the bottom of the air chambers, and means to unload said central hold.

2. A suction dredger as claimed in claim 1, said discharge valves being located at a level above said means for unloading the central hold.

* * * * *